US005951244A

United States Patent [19]

Knight, Sr.

[11] Patent Number: 5,951,244

[45] Date of Patent: Sep. 14, 1999

[54] IMPELLER CLEARANCE ADJUSTMENT SYSTEM

[76] Inventor: Michael J. Knight, Sr., 396 Royce St., Pensacola, Fla. 32503

[21] Appl. No.: 09/013,739

[22] Filed: Jan. 27, 1998

[51] Int. Cl.[6] ..... F01D 5/02; F03B 1/02

[52] U.S. Cl. ..... 415/132; 411/383; 411/395

[58] Field of Search ..... 415/131, 132; 411/383, 384, 393, 395

[56] References Cited

U.S. PATENT DOCUMENTS

| | | | |
|---|---|---|---|
| 94,868 | 9/1869 | Chase | 415/131 X |
| 1,281,478 | 10/1918 | Antisell | 415/131 |
| 2,434,018 | 1/1948 | Stepanoff | 415/132 X |
| 3,711,218 | 1/1973 | Kennel et al. | 415/131 |
| 4,439,096 | 3/1984 | Rockwood et al. | 415/131 |
| 5,344,291 | 9/1994 | Antkowiak | 415/132 X |
| 5,609,454 | 3/1997 | Lee | 411/384 |
| 5,690,456 | 11/1997 | Wedellsborg | 411/384 X |

FOREIGN PATENT DOCUMENTS

| | | | |
|---|---|---|---|
| 788713 | 10/1935 | France | 415/131 |
| 376105 | 10/1939 | Italy | 411/383 |
| 2266749 | 11/1993 | United Kingdom | 415/131 |

OTHER PUBLICATIONS

Bulletin 725.1 "Gould Pumps" dated Jan. 1980 Goulds Model 3196 ANSI Standard Dimension Process Pumps.

*Primary Examiner*—John Ryznic
*Attorney, Agent, or Firm*—Peter Loffler

[57] ABSTRACT

An impeller clearance adjustment system provides for the desired clearance between an impeller and suction housing irrespective of the amount of torque applied to the bolts of the adjustment system. A bearing frame has a plurality of generally evenly spaced apart threaded first openings while a bearing housing has a plurality of threaded second openings registerable with the first openings. An adjustment bolt, having an opening in its central axis, is threadably inserted into each of the second openings and abuts the bearing frame. An attachment bolt is inserted through each adjustment bolt's opening and is received within the respective first opening. Once the impeller clearance is set, each attachment bolt is tightened thereby maintaining the set impeller clearance.

6 Claims, 3 Drawing Sheets

IMPELLER CLEARANCE ADJUSTMENT SYSTEM

BACKGROUND OF THE INVENTION

1. Field of the Invention

The present invention relates to an attachment system for adjusting the clearance between an impeller and a suction housing of a standard impeller pump.

2. Background of the Prior Art

In a typical impeller pump, such as the Model 3196 series of pumps produced by Gould Pumps, Inc., of Seneca Falls N.Y., the bearing housing and the bearing frame are two separate items attached to one another. A first series of generally evenly spaced apart bolts, typically three in number and referred to as attaching bolts, pass through the bearing housing and are threadably received within the bearing frame. A second series of generally spaced apart (from each other and from the first series of bolts) bolts, also typically three in number and referred to as held bolts, pass threadably through the bearing housing and abut the bearing frame. The clearance achieved between the impeller and the suction housing (the impeller clearance) is in the order of a fraction of an inch with the precise clearance being pump size and model specific. The first series of bolts and the second series of bolts cooperatively work to achieve the desired clearance. Tightening of the first series of bolts draws the impeller closer to the suction housing while tightening the second series of bolts moves the impeller further from the suction housing. Applying the proper torque to each series of bolts will produce the appropriate push and pull forces on the pump elements (shaft, bearings, impeller, and bearing housing) such that the desired clearance between the impeller and the suction housing is achieved and the pump operates with maximum efficiency.

The factory recommended torque for these bolts for the Model 3196 pumps is 23 foot-pounds lubricated and 33 foot-pounds dry. If the bolts are torqued to factory specifications, the shaft acts as a lever and loads the floating bearing and the held bearing. This removes the running clearance between the rotating balls of the bearing and the inner and outer races of the bearing greatly reducing the running life of the bearing. This also causes the pump to work hard and thus operate less efficiently.

Therefore, there is a need in the art for a mechanism that will provide for the appropriate adjustment in order to achieve the appropriate clearance between the impeller and the suction housing without preloading the bearings. The mechanism must be simple in design and must be quick and easy to use. The device must not rely on specialized tools such as torque wrenches in order to achieve the desired result.

SUMMARY OF THE INVENTION

The impeller clearance adjustment system of the present invention addresses the aforementioned needs in the art. The device provides for a mechanism that provides for quick, easy and accurate adjustment of the clearance between the impeller and the suction housing of an impeller pump without the need for a torque wrench.

The impeller clearance adjustment system is comprised of a plurality of spaced apart adjustment bolts, each bolt passes through a threaded opening in the bearing housing and abuts against the bearing frame. A bore opening passes through the central axis of each adjustment bolt. An attachment bolt passes through the opening of each adjustment bolt and is threadably received within the bearing frame. Once each bolt is properly positioned, the clearance between the impeller and the suction housing is established. Thereafter, each attachment bolt is tightened while the adjustment bolt is held. This simultaneous tightening ensures that the bearing housing does not move relative to the bearing frame and thus the desired impeller clearance is maintained.

Therefore, it is an object of the present invention to provide an impeller clearance adjustment system that is quick and easy to adjust.

It is another object of the present invention to provide an impeller clearance adjustment system that does not require a torque wrench for adjustment.

It is another object of the present invention to provide an impeller clearance adjustment system that minimizes the potential of loading the floating bearing and the held bearing.

It is another object of the present invention to provide an impeller clearance adjustment system that maintains the efficiency of the impeller pump It is a final object of the present invention to provide an impeller clearance adjustment system that reduces maintenance costs associated with the impeller pump.

BRIEF DESCRIPTION OF THE DRAWINGS

Similar reference numerals refer to similar parts throughout the several views of the drawings.

DESCRIPTION OF THE PREFERRED EMBODIMENT

Figure 1:
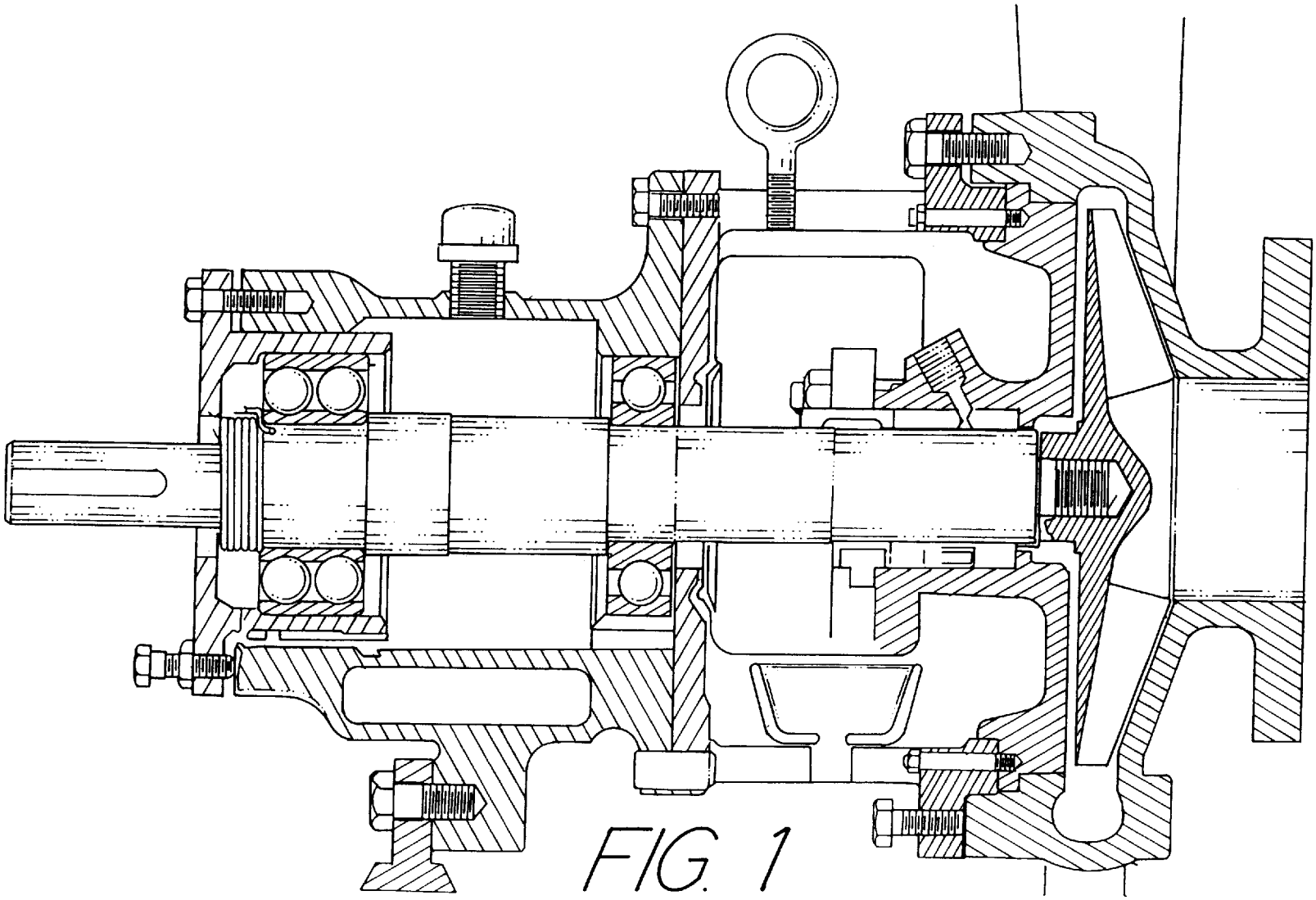
FIG. 1 Prior Art
FIG. 1 is a sectioned side view of an impeller pump utilizing a prior art impeller clearance adjustment system.

Referring now to the drawings, it is seen that the impeller clearance adjustment system is comprised of a bearing housing 12 and a bearing frame 14. The bearing housing 12 is of any desired design with the exception that the bearing housing 12 has a plurality of generally evenly spaced apart threaded openings. Likewise, the bearing frame 14 is of any desired design with the exception that the bearing frame 12 has a plurality of spaced apart openings registerable with the openings of the bearing housing 12 when the bearing frame 14 is properly positioned relative to the bearing housing 12.

Figure 4:
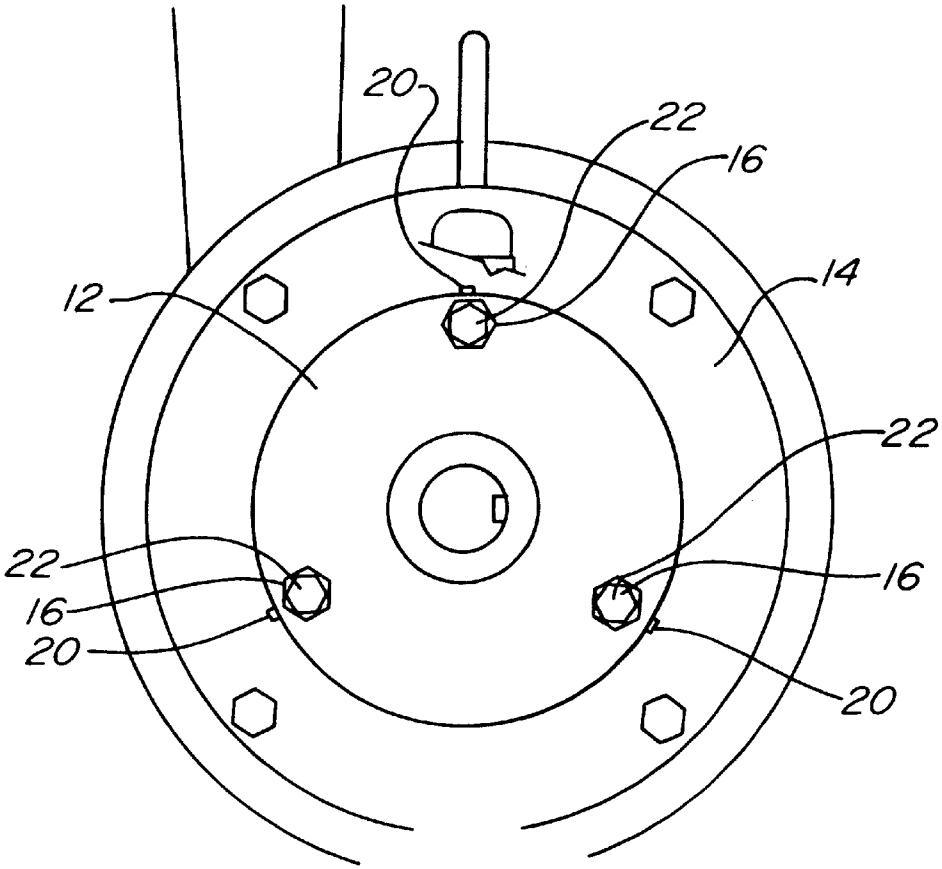
FIG. 4 is an end view of FIG. 3.
Figure 2:
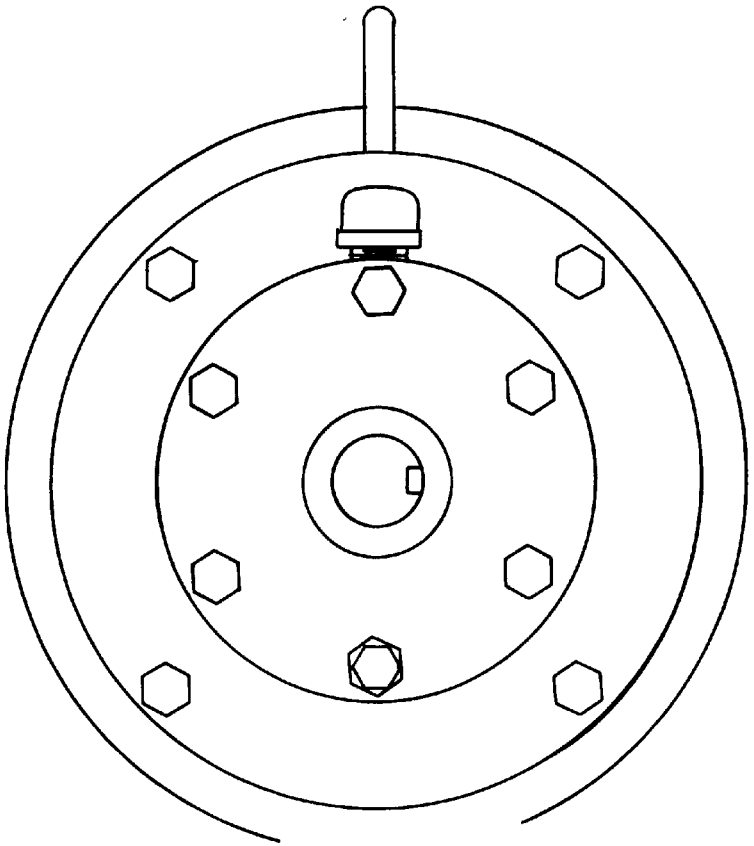
FIG. 2 PRIOR ART
FIG. 2 is an end view of FIG. 1.
Figure 5:
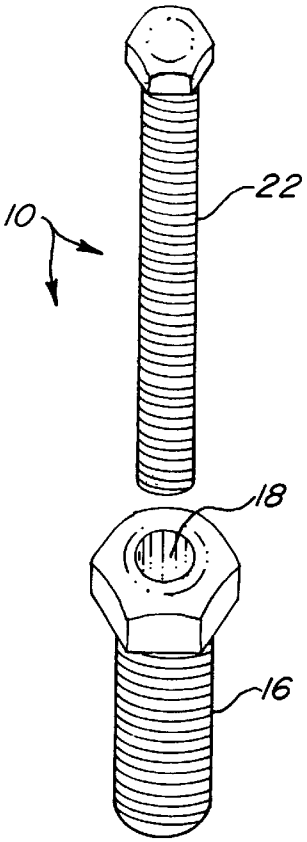
FIG. 5 is a perspective view of the adjustment bolt and the attachment bolt.
Figure 3:
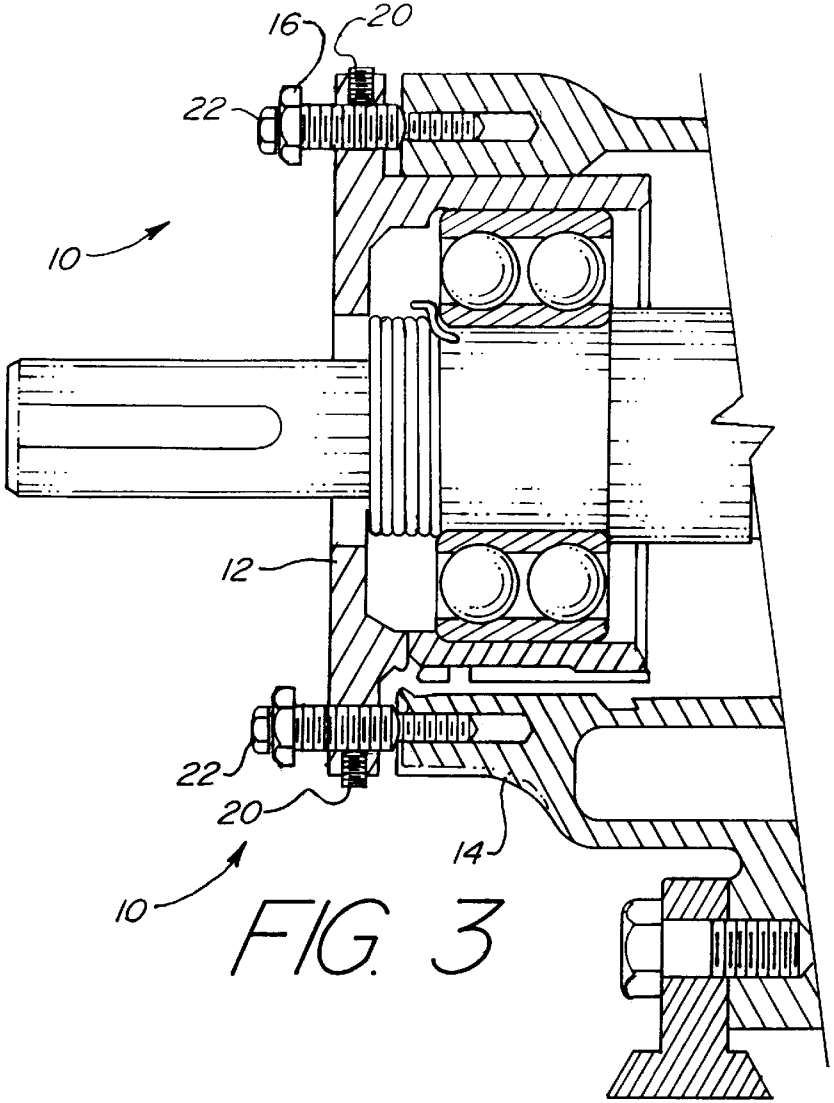
FIG. 3 is a sectioned side view of an impeller pump utilizing the impeller clearance adjustment system of the present invention.

As seen in FIGS. 3–5, a threaded adjustment bolt 16 is threadably passed through an opening of the bearing housing 12 and abuts the bearing frame 14. The end of each adjustment bolt 16 is squared and the cross section is greater than the cross section of each opening on the bearing frame 14 so that the adjusting bolt does not enter the opening of the bearing frame 14. The adjustment bolt 16 is dimensioned so that when each is fully inserted into its respective opening on the bearing housing 12, (thus when each adjustment bolt 16 has exerted its maximum push on the bearing frame 14 relative to the bearing housing 12) the impeller clearance is at the greatest desired distance. As seen in FIGS. 3 and 5, a bore opening 18 passes through the central axis of each adjustment bolt 16.

Once the bearing housing 12 and the bearing frame 14 are installed relative to each other, the openings on the bearing housing 12 are aligned with the openings on the bearing frame 14 and an adjustment bolt 16 is passed through each aligned opening pair. If desired, a lock nut 20 or set screw is positioned between the head of the adjustment bolt 16 and the bearing housing 12.

Thereafter, a threaded attachment bolt 22 is passed through the opening 18 of each adjustment bolt 16 and is threadably received within the opening on the bearing frame 14. The attachment bolt 22 is dimensioned so that is can pass through the adjustment bolt opening 18 without undue hardship yet is relatively snug therein. The attachment bolt 22 is further dimensioned so that when it is fully received within the bearing frame opening (thus when each attachment bolt 22 has exerted its maximum draw on the bearing housing 12 relative to the bearing frame 14) the impeller clearance is at the smallest desired distance. Thereafter, the impeller clearance is set and each attachment bolt 22 is tightened while holding the adjustment bolt 16 from turning. The adjustment bolt 16 exerts a pushing force on the bearing frame 14 to push the bearing housing 12 away from the bearing frame 14 when the adjustment bolt 16 is rotated into the bearing housing opening while the attachment bolt 22 exerts a drawing force on the bearing housing 12 drawing the bearing housing 12 toward the bearing frame 14 when the attachment bolt 22 is rotated into the suction housing 14. Therefore, the two equal and opposite forces cancel each other and the tightening of attachment bolt 22 and holding adjustment bolt 16 will not disturb the impeller clearance distance irrespective of the amount of torque applied (within reason) to the attachment bolt 22.

While the invention has been particularly shown and described with reference to an embodiment thereof, it will be appreciated by those skilled in the art that various changes in form and detail may be made without departing from the spirit and scope of the invention.

I claim:

1. An attachment device comprising:

a first housing having a plurality of first spaced apart openings;

a second housing having a plurality of second spaced apart openings registerable with the plurality of first spaced apart openings;

a plurality of adjustment bolts, each having a bore opening passing through its central axis and passing through one of the plurality of first spaced apart openings and abutting the second housing; and a plurality of attachment bolts, each passing through one of the bore openings and being received within one of the plurality of second spaced apart openings.

2. The attachment device as in claim 1 wherein an end of each of the plurality of adjustment bolts is squared.

3. The attachment device as in claim 1 further comprising a plurality of nuts, each encompassing one of the plurality of adjustment bolts.

4. An impeller clearance adjustment system comprising:

a impeller having a plurality of first spaced apart openings;

a suction housing having a plurality of second spaced apart openings registerable with the plurality of first spaced apart openings;

a plurality of adjustment bolts, each having a bore opening passing through its central axis and passing through one of the plurality of first spaced apart openings and abutting the suction housing; and a plurality of attachment bolts, each passing through one of the bore openings and being received within one of the plurality of second spaced apart openings.

5. The impeller clearance adjustment system as in claim 1 wherein an end of each of the plurality of adjustment bolts is squared.

6. The impeller clearance adjustment system as in claim 1 further comprising a plurality of nuts, each encompassing one of the plurality of adjustment bolts.

* * * * *